US012674287B2

(12) United States Patent
Gorman

(10) Patent No.: US 12,674,287 B2
(45) Date of Patent: Jul. 7, 2026

(54) SYSTEMS AND METHODS FOR RESURFACING ROADS USING ROAD REJUVENATOR PRODUCTS

(71) Applicant: ALL STATES CONSTRUCTION, INC., West Springfield, MA (US)

(72) Inventor: Albert Mark Gorman, Menands, NY (US)

(73) Assignee: ALL STATES CONSTRUCTION, INC., West Springfield, MA (US)

( * ) Notice: Subject to any disclaimer, the term of this patent is extended or adjusted under 35 U.S.C. 154(b) by 967 days.

(21) Appl. No.: 17/864,489

(22) Filed: Jul. 14, 2022

(65) Prior Publication Data

US 2023/0056940 A1 Feb. 23, 2023

Related U.S. Application Data

(60) Provisional application No. 63/233,995, filed on Aug. 17, 2021.

(51) Int. Cl.
*E01C 19/48* (2006.01)

(52) U.S. Cl.
CPC ..... *E01C 19/4873* (2013.01)

(58) Field of Classification Search
CPC ..... E01C 19/17; E01C 19/16; E01C 19/176; E01C 19/4873
See application file for complete search history.

(56) References Cited

U.S. PATENT DOCUMENTS

| | | | | |
|---|---|---|---|---|
| 5,405,213 | A * | 4/1995 | O'Connor | E01C 7/187 404/107 |
| 5,851,085 | A * | 12/1998 | Campbell | E01C 19/4853 404/110 |
| 6,776,557 | B2 * | 8/2004 | Barnat | E01C 19/48 404/101 |
| 7,726,905 | B2 * | 6/2010 | Hall | E01C 23/08 404/101 |
| 8,083,434 | B1 | 12/2011 | Gorman et al. | |
| 8,202,021 | B2 | 6/2012 | Gorman et al. | |
| 10,094,074 | B2 | 10/2018 | Cawthern | |
| 10,781,561 | B2 | 9/2020 | Cawthern | |
| 10,975,530 | B2 | 4/2021 | Gorman et al. | |
| 2008/0056820 | A1 * | 3/2008 | Hall | E01C 23/07 404/75 |
| 2018/0371701 | A1 * | 12/2018 | Cawthern | E01C 19/48 |
| 2019/0242069 | A1 * | 8/2019 | Fennell | E01C 7/187 |
| 2020/0056340 | A1 * | 2/2020 | Thiesse | G01F 23/0015 |

FOREIGN PATENT DOCUMENTS

| | | | | |
|---|---|---|---|---|
| GB | 2557955 | A * | 7/2018 | B60S 1/66 |

* cited by examiner

*Primary Examiner* — Abigail A Risic
(74) *Attorney, Agent, or Firm* — Day Pitney LLP; George N. Chaclas; Christopher J. Head

(57) ABSTRACT

The disclosure provides a paving machine and related methods. In one example, a paving machine includes a first group of sprayers positioned on an underside of a body of the paving machine, and a second group of sprayers positioned downstream of the first group. The first group of sprayers dispense a first product on an existing road and the second group of sprayers dispense a second product over the first product. The paving machine includes a channel positioned downstream of the second group of sprayers to dispense an asphalt mixture over the second product, and a screed positioned adjacent to the channel in contact with the asphalt mixture.

16 Claims, 13 Drawing Sheets

SYSTEMS AND METHODS FOR RESURFACING ROADS USING ROAD REJUVENATOR PRODUCTS

PRIORITY CLAIM

The present application claims the benefit of U.S. provisional patent application Ser. No. 63/233,995, filed on Aug. 17, 2021, which is hereby incorporated by reference in its entirety.

BACKGROUND

The disclosure relates generally to road resurfacing, and more particularly, to systems and methods for resurfacing roads using road rejuvenator products.

Improved materials and paving processes continue to increase the strength and durability of paved surfaces. This in turn has increased the operational/drivable life of these roads for personal and commercial drivers. However, a number of factors continue to negatively impact paved surfaces. These factors include irregularities in materials, irregularities in processes during paving, irregularities in the existing road being paved, ambient weather and the like. These factors typically result in surface defects in the road such as cracks, unevenness, potholes and/or surface crumbling. These surface defects can reduce the strength and/or operational/drivable life of the paved surface. With reduced strength and operational/drivable life, the roads can require frequent upkeep and maintenance, and eventually require total replacement and/or resurfacing. This maintenance and/or road replacement can be costly and often requires the road to be at least partially shut down during repair and replacement.

SUMMARY

A first aspect of the disclosure provides a paving machine, including: a body including a front end, a back end positioned opposite the front end, and an underside extending between the front end and the back end; a first group of sprayers positioned on the underside of the body, the first group of sprayers for dispensing a first product on an existing road; a second group of sprayers positioned downstream of the first group of sprayers, the second group of sprayers for dispensing a second product over the first product dispensed by the first group of sprayers; a channel positioned adjacent to and downstream of the second group of sprayers, the channel providing an asphalt mixture over the second product; and a screed positioned adjacent the channel, the screed contacting the asphalt mixture provided by the channel.

A second aspect of the disclosure provides a system including: a first group of sprayers positioned on a first vehicle, the first group of sprayers for dispensing a first product on an existing road; and a paving machine including: a body including a front end, a back end positioned opposite the front end, and an underside extending between the front end and the back end; a second group of sprayers positioned downstream of the front end of the body, the second group of sprayers for dispensing a second product over the first product dispensed by the first group of sprayers; a channel positioned adjacent to and downstream of the second group of sprayers, the channel providing an asphalt mixture over the second product; and a screed positioned adjacent the channel, the screed contacting the asphalt mixture provided by the channel.

A third aspect of the disclosure provides a method for resurfacing an existing road, including: covering an exposed surface of the existing road with a first product; covering the first product disposed over the exposed surface of the existing road with a second product, the first product dispensed by a first group of sprayers includes a modifier, a liquid road rejuvenator product, or a combination of materials, and the second product dispensed by a second group of sprayers includes an asphalt emulsion; disposing an asphalt mixture directly over the second product; and shaping the asphalt mixture disposed over the second product.

The illustrative aspects of the present disclosure are designed to solve the problems herein described and/or other problems not discussed.

Two or more features described in this disclosure, including those described in this summary section, may be combined to form implementations not specifically described herein.

The details of one or more implementations are set forth in the accompanying drawings and the description below. Other features, objects and advantages will be apparent from the description and drawings, and from the claims.

BRIEF DESCRIPTION OF THE DRAWINGS

These and other features of this disclosure will be more readily understood from the following detailed description of the various aspects of the disclosure taken in conjunction with the accompanying drawings that depict various embodiments of the disclosure, in which.

It is noted that the drawings of the disclosure are not to scale. The drawings are intended to depict only typical aspects of the disclosure, and therefore should not be considered as limiting the scope of the disclosure. In the drawings, like numbering represents like elements between the drawings.

DETAILED DESCRIPTION

As an initial matter, in order to clearly describe the current disclosure it will become necessary to select certain terminology when referring to and describing relevant components within the disclosure. When doing this, if possible, common industry terminology will be used and employed in a manner consistent with its accepted meaning. Unless otherwise stated, such terminology should be given a broad interpretation consistent with the context of the present application and the scope of the appended claims. Those of ordinary skill in the art will appreciate that often a particular component may be referred to using several different or overlapping terms. What may be described herein as being a single part may include and be referenced in another context as consisting of multiple components. Alternatively, what may be described herein as including multiple components may be referred to elsewhere as a single part.

As discussed herein, the disclosure relates generally to road resurfacing, and more particularly, to systems and methods for resurfacing roads using road rejuvenator products. In various implementations, the approaches enhance bonding between an existing road and an asphalt layer formed over the existing road. Certain example implementations provide a rejuvenator or similar product over an existing road and then immediately, or with nominal delay, provide an asphalt layer over the rejuvenator. In such cases, the rejuvenator is not allowed to set over the existing road prior to application of the overlying asphalt layer. This is in contrast to conventional approaches that utilize separate machines to apply the rejuvenator and a subsequently applied asphalt layer. In various implementations, the asphalt layer is applied within minutes of the rejuvenator application. Because the rejuvenator softens the underlying existing road, applying asphalt over the hot (or at least warm) rejuvenator enhances bonding of the asphalt to the existing road when compared with conventional approaches. Additionally, integrating rejuvenation application and asphalt application in a single machine and/or single, fluid process enables faster setting of the roadway, with less downtime. These are just some of many example benefits of the disclosed approaches when considered in view of conventional systems and methods.

These and other embodiments are discussed below with reference to FIGS. 1-13. However, those skilled in the art will readily appreciate that the detailed description given herein with respect to these Figures is for explanatory purposes only and should not be construed as limiting.

Figure 1:
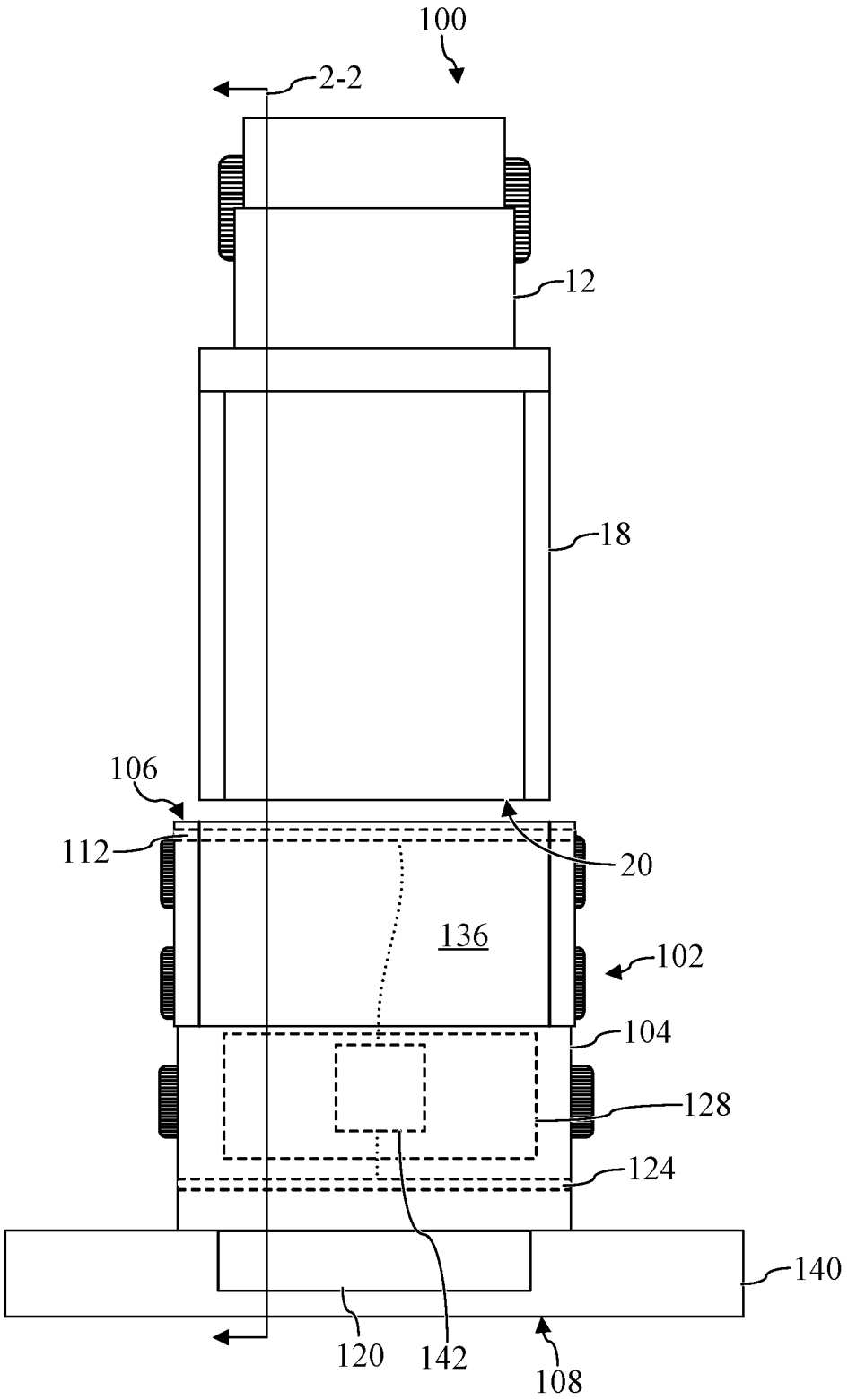
FIG. 1 shows a top view of a system including a paving machine configured to resurface an existing road, according to embodiments of the disclosure.
Figure 2:
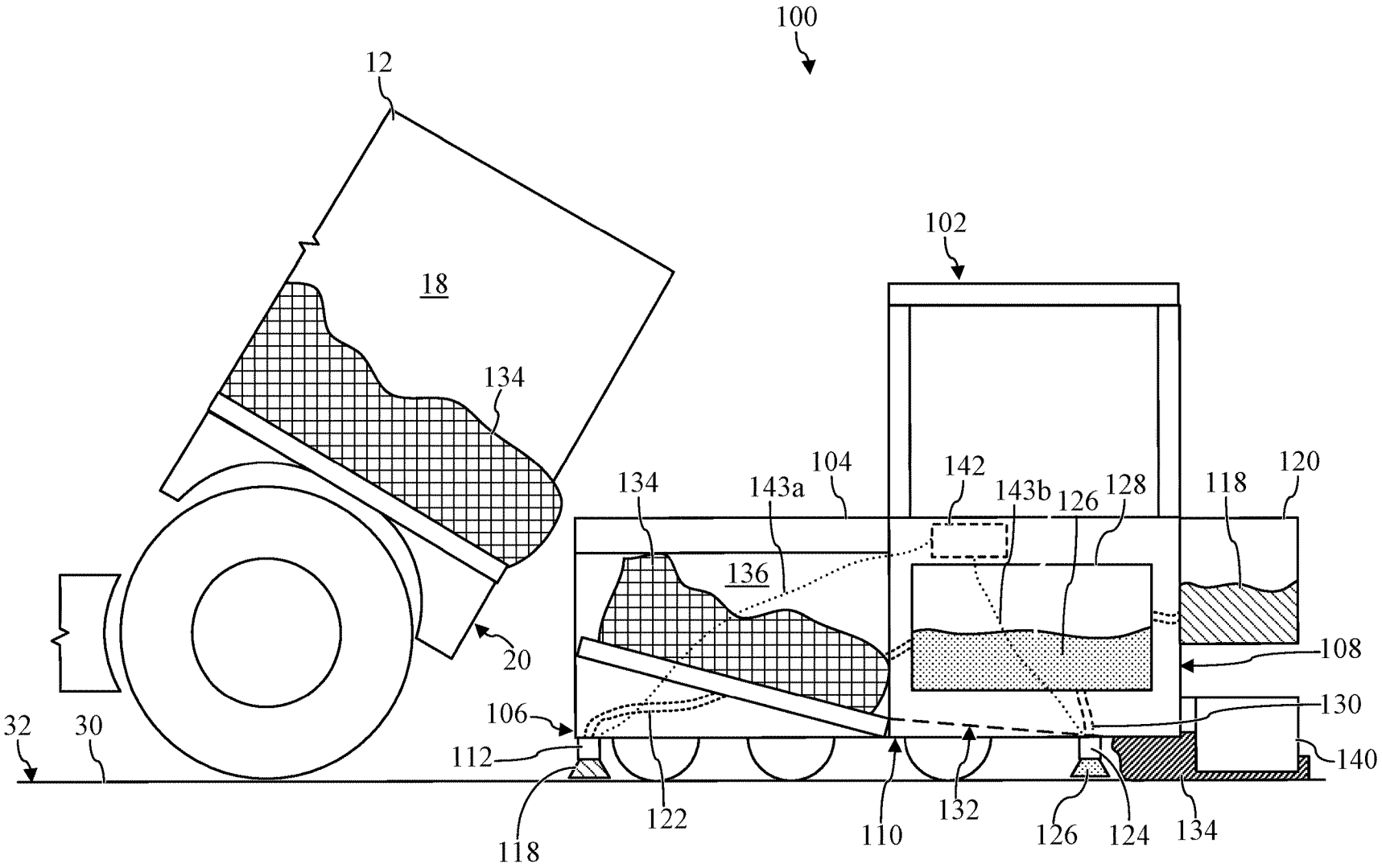
FIG. 2 shows a side cross-sectional view of the system taken along line 2-2 of FIG. 1, according to embodiments of the disclosure.

FIGS. 1 and 2 show a system 100 for resurfacing an existing road 30 (FIG. 2). Specifically, FIG. 1 shows a top view of system 100 for resurfacing existing road 30, and FIG. 2 shows a cross-sectional side view of system 100 taken along line 2-2 in FIG. 1.

In a non-limiting example system 100 may include a dump truck 12. Dump truck 12 may include a dump box 18. More specifically, dump truck 12 may include dump box 18 positioned and/or formed adjacent a rear end 20 of dump truck 12. Dump box 18 of dump truck 12 may be configured to receive, hold, store, and/or provide an asphalt mixture to a paving machine 102 of system 100 as discussed herein. In a non-limiting example shown in FIG. 2, dump box 18 of dump truck 12 may lift and/or tilt to allow gravity to move or provide the asphalt mixture to paving machine 102 positioned there behind. Although shown and discussed herein as any suitable dump truck 12, it is understood that the first vehicle of system 100 may be formed as any vehicle, apparatus, and/or device that may provide the asphalt mixture to paving machine 102 while system 100 resurfaces the existing road 30. For example, the first vehicle of system 100 may be formed as a conveyor belt/system in communication with a tractor-trailer containing the asphalt mixture. In this non-limiting example, the conveyor belt/system may carry the asphalt mixture from the tractor-trailer, and may subsequently provide the asphalt mixture to paving machine 102.

As shown, the paving machine 102 of system 100 may include a body 104. As shown in FIGS. 1 and 2, body 104 of paving machine 102 may include a front end 106, a back end 108 positioned opposite front end 106, and an underside 110 extending between front end 106 and back end 108. Front end 106 of the body 104 may be positioned adjacent to (and downstream of) rear end 20 of the dump truck 12 in system 100. Back end 108 of body 104 may be positioned opposite rear end 20 of dump truck 12.

As shown in FIGS. 1 and 2, paving machine 102 may also include a first group of sprayers 112. In a non-limiting example, first group of sprayers 112 may be positioned on the underside 110 of body 104 for paving machine 102. First group of sprayers 112 may be positioned on, affixed to, and/or coupled to the underside 110 of body 104 for paving machine 102. In some embodiments, as shown in FIG. 2, the first group of sprayers 112 may be positioned substantially adjacent to and/or above the existing road 30. In the non-limiting example shown in FIGS. 1 and 2, first group of sprayers 112 may also be positioned directly adjacent, but downstream from, the front end 106 of body 104 for paving machine 102. In other non-limiting examples discussed herein, first group of sprayers 112 may be positioned further downstream from front end 106. First group of sprayers 112 may also span and/or extend over substantially the entire width of paving machine 102. In other non-limiting examples, first group of sprayers 112 may span or extend beyond the width of paving machine 102, such that a portion of first group of sprayers 112 may be positioned outside of paving machine 102.

First group of sprayers 112 may include any suitable sprayer, nozzle and/or dispensing component to dispense a first product 118 onto the existing road 30. First group of sprayers 112 may be formed from any suitable dispensing component that may enable metered or controlled dispensing (e.g., controlled flow rate). First group of sprayers 112 may be configured to dispense, spray and/or cover existing road 30 with a substantially liquid binding material to form a first layer of material/product on existing road 30. Although a single bar is shown in FIGS. 1 and 2, and a single sprayer or nozzle is depicted in FIG. 2, it is understood that first group of sprayers 112 of paving machine 102 may include a plurality of individual sprayers or nozzles coupled to, supported by and/or position linearly on a support structure (e.g., bar, rail, etc.) for spraying first product 118 onto existing road 30, as discussed herein.

First product 118 dispensed by first group of sprayers 112 onto existing road 30 may include, for example, a modifier, a liquid road rejuvenator product, or a combination of materials (e.g., polymer and road rejuvenator). In the non-limiting examples, a rejuvenator product may be pine-based, petroleum-based, corn oil-based, or the like. First product 118 may be included and/or contained within paving machine 102 in a storage tank 120. In the non-limiting example shown in FIGS. 1 and 2, storage tank 120 may be formed as a saddle container or storage component that may be configured to store first product 118 (e.g., road rejuvenator product) directly on paving machine 102.

In a non-limiting example, storage tank 120 may be in fluid communication with first group of sprayers 112. Storage tank 120 may be in fluid communication and/or fluidly coupled with first group of sprayers 112 via a supply conduit 122. As shown in FIG. 2, paving machine 102 may include a first conduit 122 coupled to storage tank 120 and first group of sprayers 112. First conduit 122 may carry, flow, and/or move first product 118 in storage tank 120 to first group of sprayers 112. In a non-limiting example, first product 118 may flow from storage tank 120 to first group of sprayers 112, via first conduit 122, based on a gravity feed and/or gravity force. In other non-limiting examples, the flow of first product 118 from storage tank 120 to first conduit 122, and ultimately sprayers 112, may be mechanically/fluidically controlled using any suitable device or component (e.g., pump). As such, and as similarly discussed herein with respect to the first group of sprayers 112, the flow rate of first product 118 may be substantially controlled. As discussed herein, first group of sprayers 112 may dispense first product 118 supplied by conduit 122 onto existing road 30 during a road resurfacing process. First conduit 122 may be any suitable conduit, pipe, hose and/or other channel for moving and/or flowing first product 118 from storage tank 120 to first group of sprayers 112.

Paving machine 102 may also include a second group of sprayers 124 (shown in phantom in FIG. 1) positioned proximate to first group of sprayers 112. Specifically, and as shown in FIGS. 1 and 2, second group of sprayers 124 may be positioned substantially downstream from first group of sprayers 112. Additionally, second group of sprayers 124 may be positioned adjacent back end 108 of body 104 for paving machine 102 and upstream of a screed included in paving machine 102. Similar to first group of sprayers 112, second group of sprayers 124 may be positioned on, fixed and/or coupled to an underside 110 of paving machine 102, and may be positioned substantially adjacent to and/or above existing road 30. In a non-limiting example shown in FIG. 1, second group of sprayers 124 may span and/or extend over substantially the entire width of paving machine 102. In other non-limiting examples, second group of sprayers 124 may span or extend over only a portion of the width of paving machine 102, or alternatively, may span or extend beyond the width of paving machine 102.

Although shown to be substantially similar in length, it is understood that first group of sprayers 112 and second group of sprayers 124 may extend over distinct distances of the width of paving machine 102. That is, in a non-limiting example shown in FIG. 1, first group of sprayers 112 and second group of sprayers 124 may be substantially aligned and may each extend over substantially the entire width of paving machine 102. In other non-limiting examples, first group of sprayers 112 may extend over a first width of paving machine 102, and second group of sprayers 124 may extend over a second width of paving machine 102 different than the first width.

Similar to first group of sprayers 112, second group of sprayers 124 may include any suitable sprayer, nozzle, and/or dispensing component that may dispense a second product 126. Second group of sprayers 124 may dispense a second product 126 over first product 118 dispensed by first group of sprayers 112 onto existing road 30. Second group of sprayers 124 may be configured to dispense, spray, and/or cover first product 118 dispensed by first group of sprayers 112 with second product 126 to form a second layer of material/product over existing road 30. Although a single bar is shown in FIG. 1, and a single sprayer or nozzle is depicted in FIG. 2, it is understood that second group of sprayers 124 of paving machine 102 may include a plurality of individual sprayers or nozzles coupled to, supported by and/or position linearly on a support structure (e.g., bar, rail and so on) for spraying a binding material onto existing road 30, as discussed herein.

Second product 126 dispensed by second group of sprayers 124 over existing road 30 may include, for example, an asphalt emulsion, asphalt cement, polymer material, polymer modified asphalt cement, and the like. Second product 126 may be included and/or contained within paving machine 102 in a storage container 128. In the non-limiting example shown in FIGS. 1 and 2, storage container 128 may be formed as a storage component that may integrally formed and/or included within paving machine 102, and may be configured to store second product 126 directly on paving machine 102.

In a non-limiting example, storage container 128 may be in fluid communication with second group of sprayers 124. Storage container 128 may be in fluid communication and/or fluidly coupled with second group of sprayers 124 via a supply conduit 130. As shown in FIG. 2, paving machine 102 may include a second conduit 130 coupled to storage container 128 and second group of sprayers 124. Second conduit 130 may carry, flow, and/or move second product 126 in storage container 128 to second group of sprayers 124. In a non-limiting example, second product 126 may flow from storage container 128 to second group of sprayers 124, via second conduit 130, based on a gravity feed and/or gravity force. In other non-limiting examples, the flow of second product 126 from storage container 128 to second conduit 130, and ultimately sprayers 124, may be mechanically/fluidically controlled using any suitable device or component (e.g., pump). As such, and as similarly discussed herein with respect to the second group of sprayers 124, the flow rate of second product 126 may be substantially controlled. As discussed herein, second group of sprayers 124 may dispense second product 126 supplied by conduit 130 over first product 118 covering existing road 30 during a road resurfacing process. Second conduit 130 may be any suitable conduit, pipe, hose, and/or other channel for moving and/or flowing second product 126 from storage container 128 to second group of sprayers 124.

Paving machine 102 may also include a channel 132 positioned adjacent second group of sprayers 124. As shown in FIG. 2, a portion of channel 132 may be positioned adjacent and downstream of second group of sprayers 124. The portion of channel 132 positioned adjacent second group of sprayers 124 may be open to and/or positioned above existing road 30. The remaining portion of channel 132 may be formed and/or extend within body 104 of paving machine 102 and may be positioned above and/or over first group of sprayers 112, and second group of sprayers 124, respectively. As shown in FIG. 2, channel 132 may extend over first group of sprayers 112 and second group of sprayers 124, and may extend toward existing road 30 to supply an asphalt mixture 134 to existing road 30. That is, and as discussed herein in detail, channel 132 may supply an asphalt mixture 134 over second product 126 formed by second group of sprayers 124 of paving machine 102.

Paving machine 102 may also include a hopper 136 which may be positioned on, coupled to, and/or may be formed integrally with body 104 of paving machine 102, such that hopper 136 moves with paving machine 102 during the road resurfacing process discussed herein. Hopper 136 may receive and temporarily store and/or hold asphalt mixture 134. In non-limiting examples, hopper 136 may be formed from any suitable container, bin, tank, receptacle, and/or vessel capable of storing and/or receiving asphalt mixture 134.

In a non-limiting example, hopper 136 may contain and/or store asphalt mixture 134 to be used in the road resurfacing process performed by paving machine 102, as discussed herein. In another non-limiting example, hopper 136 may receive asphalt mixture 134 from dump truck 12 positioned in front of hopper 136. In a non-limiting example shown in FIG. 2, dump truck 12 may move down existing road 30 with paving machine 102 during the road resurfacing process discussed herein, and may continuously or intermittently provide, pour, and/or dump asphalt mixture 134 into hopper 136 of paving machine 102. Although discussed herein as a dump truck, it is understood that system 100 may include any suitable device or component capable of storing a large quantity of asphalt mixture 134 and configured to provide asphalt mixture 134 to hopper 136.

As shown in FIG. 2, channel 132 may be coupled to and/or in communication with hopper 136. More specifically, channel 132 may be in communication with hopper 136 and channel 132 may receive asphalt mixture 134 from hopper 136 for use in the road resurfacing process, as discussed herein. Channel 132 and/or hopper 136 may include components for moving asphalt mixture 134 from hopper 136 to channel 132 and/or moving asphalt mixture 134 through channel 132 to be supplied and/or deposited onto existing road 30. In a non-limiting example, channel 132 and/or hopper 136 may include a screw or auger conveyor. The auger conveyor of hopper 136 may continuously mix asphalt mixture 134 within hopper 136, and may also carry and/or supply asphalt mixture 134 to channel 132. Once in channel 132, the auger conveyor of channel 132 may carry and/or move asphalt mixture 134 downstream from hopper 136 toward the portion of channel 132 open to and/or positioned directly above existing road 30. In the non-limiting example, the auger conveyor of channel 132 may then push and/or deposit asphalt mixture 134 onto existing road 30 with the assistance of gravity. In other non-limiting examples, channel 132 and/or hopper 136 may include a conveyor belt, pneumatic conveyor, vibration conveyor, roller conveyor, and/or any other conveyor system, or combination thereof, configured to move asphalt mixture 134 from hopper 136 to channel 132, and subsequently along channel 132 to existing road 30, as discussed herein.

As discussed in detail herein, asphalt mixture 134 may be a mixture of a binding material (e.g., asphalt emulsion) and aggregate (e.g., stone)—commonly known as hot mixture asphalt (HMA). In a non-limiting example shown in FIG. 2, the combination of binding material and aggregate forming asphalt mixture 134 may be pre-mixed before being supplied to dump truck 12 and/or received by hopper 136. In another non-limiting example, asphalt mixture 134 may be only partially mixed and include a portion of the desired binding material before being stored in dump truck 12 and/or received by hopper 136.

As shown in FIGS. 1 and 2, paving machine 102 may also include a screed 140. Screed 140 may be positioned adjacent channel 132 of paving machine 102. Screed 140 may be positioned downstream from channel 132, and may couple to back end 108 of body 104 for paving machine 102, directly adjacent channel 132. As such, channel 132 may be positioned between second group of sprayers 124 and screed 140. Screed 140 may contact asphalt mixture 134 after asphalt mixture 134 is supplied and/or deposited over existing road 30. Screed 140 may be positioned above existing road 30, and may contact, press, and/or apply pressure, and/or a force to asphalt mixture 134 supplied and/or deposited over existing road 30 via channel 132. Screed 140 may contact asphalt mixture 134 to substantially shape and/or form asphalt mixture 134 into a substantially compact and substantially flat exposed driving surface during the road resurfacing process discussed herein. Screed 140 may be formed from any suitable tool, device, and/or instrument configured to flatten, smooth and/or true asphalt mixture 134 over existing road 30, as discussed herein. In a non-limiting example shown in FIG. 2, screed 140 may be a floating screed.

As shown in FIG. 2, screed 140 may be positioned above existing road 30 at a predetermined distance. The predetermined distance may be dependent, at least in part, on the shape of the desired exposed surface formed from asphalt mixture 134, the amount of force and/or pressure to be applied to the asphalt mixture 134 during the road resurfacing process, the density or compactness of the asphalt mixture 134, the amount of asphalt mixture 134 supplied to existing road 30, the desired thickness of the exposed surface formed by asphalt mixture 134 during the road resurfacing process, etc. The predetermined distance may be controlled and achieved by, for example, an actuator of paving machine 102. The actuator may couple to body 104 of paving machine 102 and screed 140 for substantially controlling and/or adjusting the distance between existing road 30 and screed 140 to the predetermined distance. In non-limiting examples, the actuator may be formed from any suitable actuator component configured to adjust the position of screed 140 with respect to existing road 30 including, but not limited to, electrical actuators, hydraulic actuators, pneumatic actuators, magnetic actuators, mechanical actuators, etc.

System 100 may also include a control system 142. As shown in FIGS. 1 and 2, control system 142 may be positioned on and/or coupled to paving machine 102 of system 100. Control system 142 may be in electrical communication with various components of paving machine 102 utilized in the road resurfacing process discussed herein. As shown in FIG. 2, control system 142 may be electrically coupled to and/or in electrical communication with various components of paving machine 102, including, but not limited to, first group of sprayers 112, second group of sprayers 124, channel 132, hopper 136, and/or screed 140. For instance, control system 142 may be electrically coupled to the first group of sprayers 112 via a first wire **143*a* to activate or deactivate dispensing of the first product 118. Control system 142 may be electrically coupled to the second group of sprayers 124 via a second wire 143*b* to activate or deactivate dispensing of the second product 126. Alternatively, or additionally, control system 142 may communicate with the first group of sprayers 112 and second group of sprayers 124 via a wireless communication protocol (e.g., Bluetooth) to activate or deactivate dispensing of the first product 118 and second product 126**, respectively.

Control system 142 may be configured to control the function and/or operation of the various components of system 100 in which control system 142 may be in electrical communication. Specifically, control system 142 of system 100 may be configured to control the function and/or operation of first group of sprayers 112, second group of sprayers 124, channel 132, hopper 136, and/or screed 140. In non-limiting examples, control system 142 may be configured to control the distribution (e.g., flow rate) of first product 118 as it is dispensed over existing road 30 via first group of sprayers 112 and/or second group of sprayers 124.

The distribution of the various materials deposited and/or supplied by the various components of system 100/paving machine 102 may be based, at least in part, on specific, predetermined characteristics and/or properties of existing road 30, the desired finish of the resurfaced road and/or the characteristics of the material used by system 100 to form the resurfaced road. In non-limiting examples, the material composition of the existing road's exposed surface, the condition (e.g., number of surface defects) of existing road 30, the age of existing road 30 and/or the grade of existing road may be some of the properties and/or characteristics that influence the distribution of the various materials utilized by system 100/paving machine 102 and controlled by control system 142. In other non-limiting examples, the material composition of first product 118, second product 126, and/or asphalt mixture 134, the desired thickness of a top layer formed by asphalt mixture 134, and/or the desired additional strength/defect mitigation to be provided to the resurfaced road via first product 118 may also influence the distribution of the various materials utilized by paving machine 102 and controlled by control system 142. It is understood that the predetermined characteristics and/or properties that influence the distribution of the various materials are merely illustrative and are not meant to be exhaustive. Other such predetermined characteristics and/or properties may also influence the distribution of the various materials utilized by system 100.

Control system 142 may be formed as, or a part of, a user-interactive or automated computer or computing system for controlling the function and/or operation of the various components of system 100/paving machine 102, as discussed herein. Specifically, control system 142 may be included within a computing system or device that can control the function and/or operation of the various components of paving machine 102 to perform the road resurfacing process discussed herein. The computing system or device may include one or more general purpose computing articles of manufacture (e.g., computing devices) capable of executing program code, such as control system 142, installed thereon. Although not shown, computing system or device including control system 142 may include a processing component (e.g., one or more processors), a storage component (e.g., a storage hierarchy), an input/output (I/O) component (e.g., one or more I/O interfaces and/or devices), and a communications pathway. In general, the processing component executes program code, such as that of control system 142 configured to control the function and/or operation of the various components of paving machine 102, which is at least partially fixed in the storage component. While executing program code, the processing component can process data, which can result in reading and/or writing transformed data from/to the storage component and/or the I/O component for further processing. The pathway provides a communications link between each of the components in the computing device. The I/O component can include one or more human I/O devices, which enable a user (e.g., paving machine 102 operator) to interact with the computing device and/or one or more communications devices to enable the user to communicate with the computing device using any type of communications link. In some embodiments, the user (e.g., paving machine 102 operator) can interact with a human-machine interface, which allows the user to communicate with control system 142 of the computing device. The human-machine interface can include: an interactive touch screen, a graphical user display or any other suitable human-machine interface. The computing system may also include a number of sensors positioned on each of the various components of paving machine 102. The sensors may be configured to monitor the distribution of the materials by paving machine 102, and provide data and/or feedback to the computing system including control system 142. In a non-limiting example, the computing system and/or control system 142 may obtain and analyze this data and/or feedback from the sensors of the computing system, and may adjust the distribution of the various components of paving machine 102 accordingly.

Although discussed herein as being controlled using control system 142, it is understood that operation and/or function of paving machine 102 and/or the various components of system 100 may be controlled and/or modified manually. For example, it is understood that the distribution (e.g., flow rate) of first product 118 from first group of sprayers 112 may be modified and/or controlled by manually adjusting the sprayer components of first group of sprayers 112. Additionally, the operation and/or function of paving machine 102 and/or the various components of system 100 may be controlled and/or modified using both control system 142 and manual adjustments to ensure the resurfaced road formed by system 100 meets desired specifications.

Figure 3:
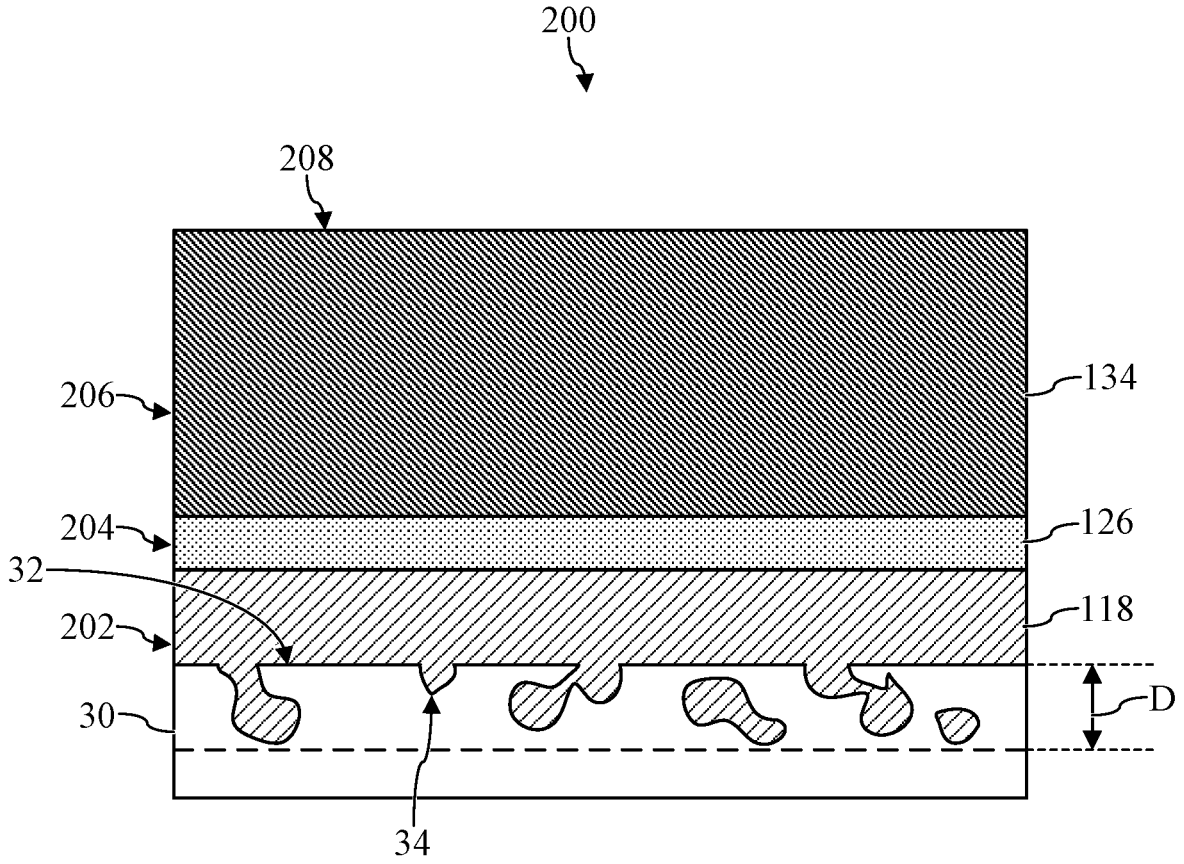
FIG. 3 shows a side cross-sectional view of a road resurfaced by the system of FIG. 1, according to embodiments of the disclosure.

FIG. 3 shows a side view of a portion of a resurfaced road 200 formed by a method disclosed, according to embodiments. With continued reference to FIGS. 1 and 2, the various portions of resurfaced road 200 and the formation of resurfaced road 200 may now be discussed in detail. It is understood that similarly named components or similarly numbered components may function in a substantially similar fashion, may include similar materials and/or may include similar interactions with other components. Redundant explanation of these components has been omitted for clarity.

As shown in FIG. 3, the first product 118 may be disposed over the existing road 30 to form a layer 202 of first product 118. Specifically, the layer 202 of first product 118 may be disposed over, and substantially cover, an exposed surface 32 of the existing road 30. Forming layer 202 of resurfaced road 200 may include bonding first product 118 to the exposed surface 32 of existing road 30. Additionally, as shown in the non-limiting example of FIG. 3, first product 118 may also be disposed in and/or substantially fill surface defects 34 (e.g., cracks, divots, potholes and so on) of existing road 30 to substantially seal the existing road 30. Chemical properties of first product 118 (e.g., rejuvenator) may enable a portion of the first product 118 to flow below the exposed surface 32. More specifically, first product 118 may seep, be disposed within, and/or penetrate the existing road 30 to substantially repair a portion of existing road 30. First product 118 may repair existing road 30 by altering the chemical, material, and/or mechanical composition of the existing road 30 to "self-repair" any internal defeats. In some embodiments, the first product 118 may include a bio-based road rejuvenator such as, e.g., pine-based composition, corn oil-based composition, etc., and penetrate the existing road 30 and temporarily soften/loosen the liquid asphalt included in existing road 30. In some embodiments, the first product 118 may include a petroleum-based road rejuvenator, penetrating the existing road 30 and substantially replacing broken down or no longer present portions/compounds/compositions of the liquid asphalt of existing road 30. In some embodiments, the first product 118 may restore the properties (e.g., material, physical, chemical, etc.) of liquid asphalt within existing road 30, such that properties of the liquid asphalt within the existing road 30 after exposure to first product 118 are substantially similar to the properties of liquid asphalt when the existing road 30 was initially formed.

In order to achieve the bonding, filling, and/or sealing of existing road 30, first product 118 forming layer 202 of resurfaced road 200 may be formed from materials and/or material compositions having specific predetermined characteristics and/or properties. The predetermined characteristics and/or properties of first product 118 may include, but are not limited to, substantially adhesive properties, substantially elastic properties, and time/temperature-based curing properties. The predetermined characteristics and/or properties of first product 118 (e.g., road rejuvenator) may also determine a distance (D) in which first product 118 may penetrate and/or repair existing road 30.

As shown in FIG. 3, a layer 204 of second product 126 may be disposed over layer 202 of first product 118. Layer 204 of second product 126 may cover layer 202 of first product 118, and/or may cover a portion of exposed surface 32 that may previously have allowed first product 118 to penetrate existing road 30 below exposed surface 32. As discussed herein, second product 126 forming layer 204 of resurfaced road 200 may be formed as and/or may substantially include, for example, an asphalt emulsion.

Resurfaced road 200 may also include a top layer 206 of asphalt mixture 134 positioned on layer 204 of second product 126. As shown in FIG. 3, asphalt mixture 134 forming top layer 206 may be positioned and/or disposed directly on and may cover layer 204 of second product 126. Asphalt mixture 134 forming top layer 206 may be positioned directly on layer 204 and may be embedded and/or bonded to second product 126 forming layer 204. Similar to the way in which layer 202 of first product 118 may be bonded to existing road 30, asphalt mixture 134 may be embedded in and/or bonded to layer 204 of second product 126. Embedding and/or bonding asphalt mixture 134 within layer 204 of second product 126 may be achieved as a result of the adhesive, elastic, and/or curing properties of second product 126 forming layer 204.

Additionally, embedding and/or bonding asphalt mixture 134 may be achieved when asphalt mixture 134 is shaped to form top layer 206. Asphalt mixture 134 may be subject to and/or experience an applied pressure or force to substantially shape and/or form asphalt mixture 134 into a substantially compact and substantially flat top layer 206 of resurfaced road 200. The applied pressure or force may embed asphalt mixture 134 at least partially into layer 204 of second product 126 and/or may bond asphalt mixture with layer 204. Top layer 206 formed by shaped asphalt mixture 134 may include a newly exposed driving surface 208 to be driven on by users of resurfaced road 200. As discussed herein, asphalt mixture 134 may be formed from a composition of second product 126 and aggregate (not shown). In non-limiting examples, asphalt mixture 134 may be formed from and/or may be a composition of aggregate (e.g., sized stone material) and second product 126 including, but not limited to, asphalt emulsion, asphalt cement, polymer material, polymer modified asphalt cement and the like. Briefly returning to FIG. 2, and as discussed above, asphalt mixture 134 may be deposited directly onto layer 204 of second product 126 using channel 132 and hopper 136, and may be shaped to form top layer 206 of resurfaced road 200 using screed 140 of paving machine 102.

FIGS. 4-8 show cross-sectional side views of system 100 including paving machine 102 according to additional, non-limiting examples. It is understood that similarly named components or similarly numbered components may function in a substantially similar fashion, may include similar materials and/or may include similar interactions with other components. Redundant explanation of these components has been omitted for clarity.

Figure 4:
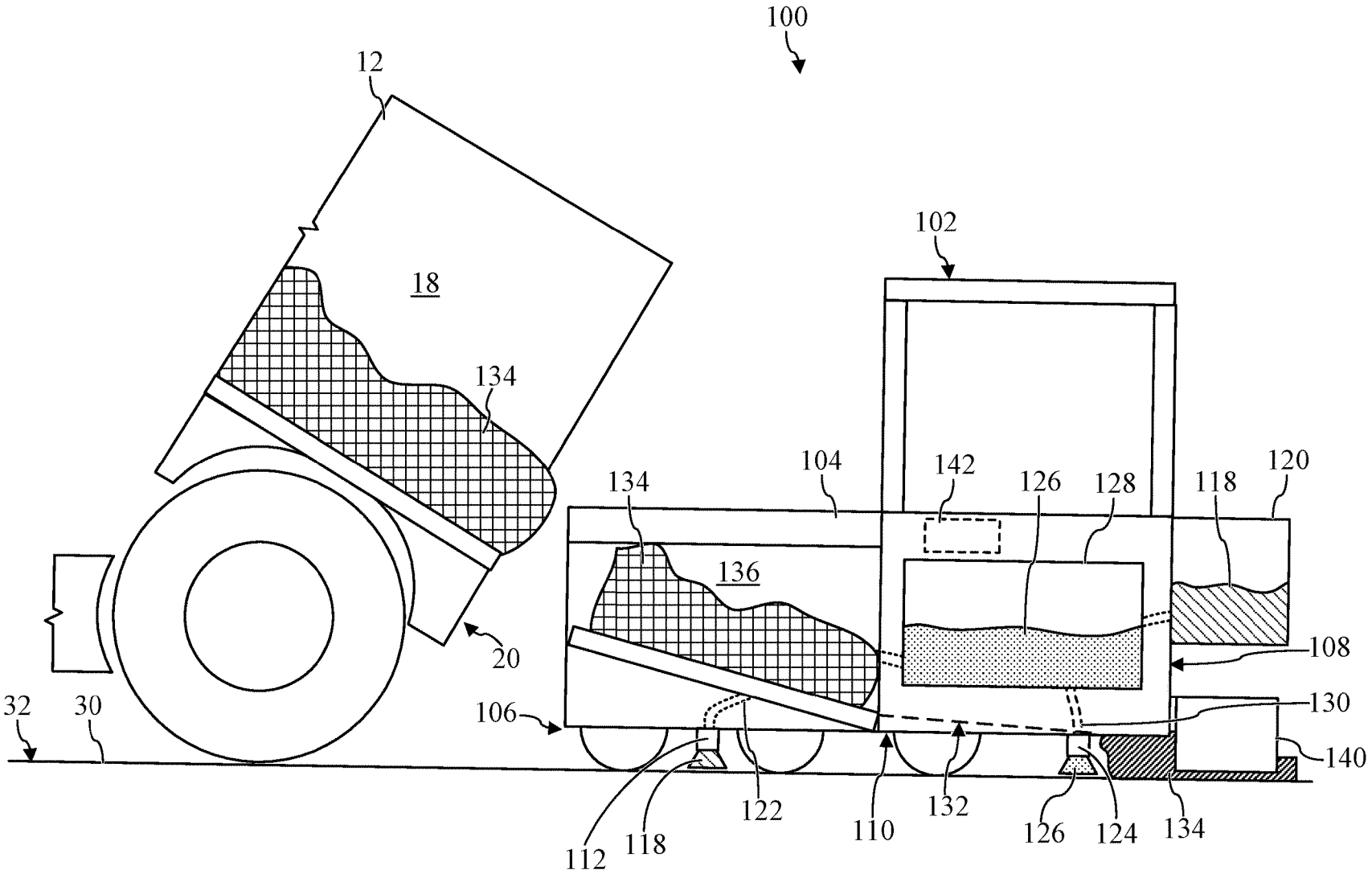
FIGS. 4-8 show side cross-sectional views of a system including a paving machine, according to additional embodiments of the disclosure.

In the non-limiting example shown in FIG. 4, first group of sprayers 112 may be positioned on underside 110 of body 104 for paving machine 102, and may also be positioned downstream from front end 106 of body 104 for paving machine 102. Distinct from the non-limiting example shown and discussed herein with reference to FIG. 2, first group of sprayers 112 shown in the non-limiting example of FIG. 4 may not be positioned directly adjacent front end 106 of paving machine 102, e.g., between wheels. Rather, first group of sprayers 112 may be positioned toward or adjacent a center of paving machine 102—between front end 106 and back end 108.

Figure 5:
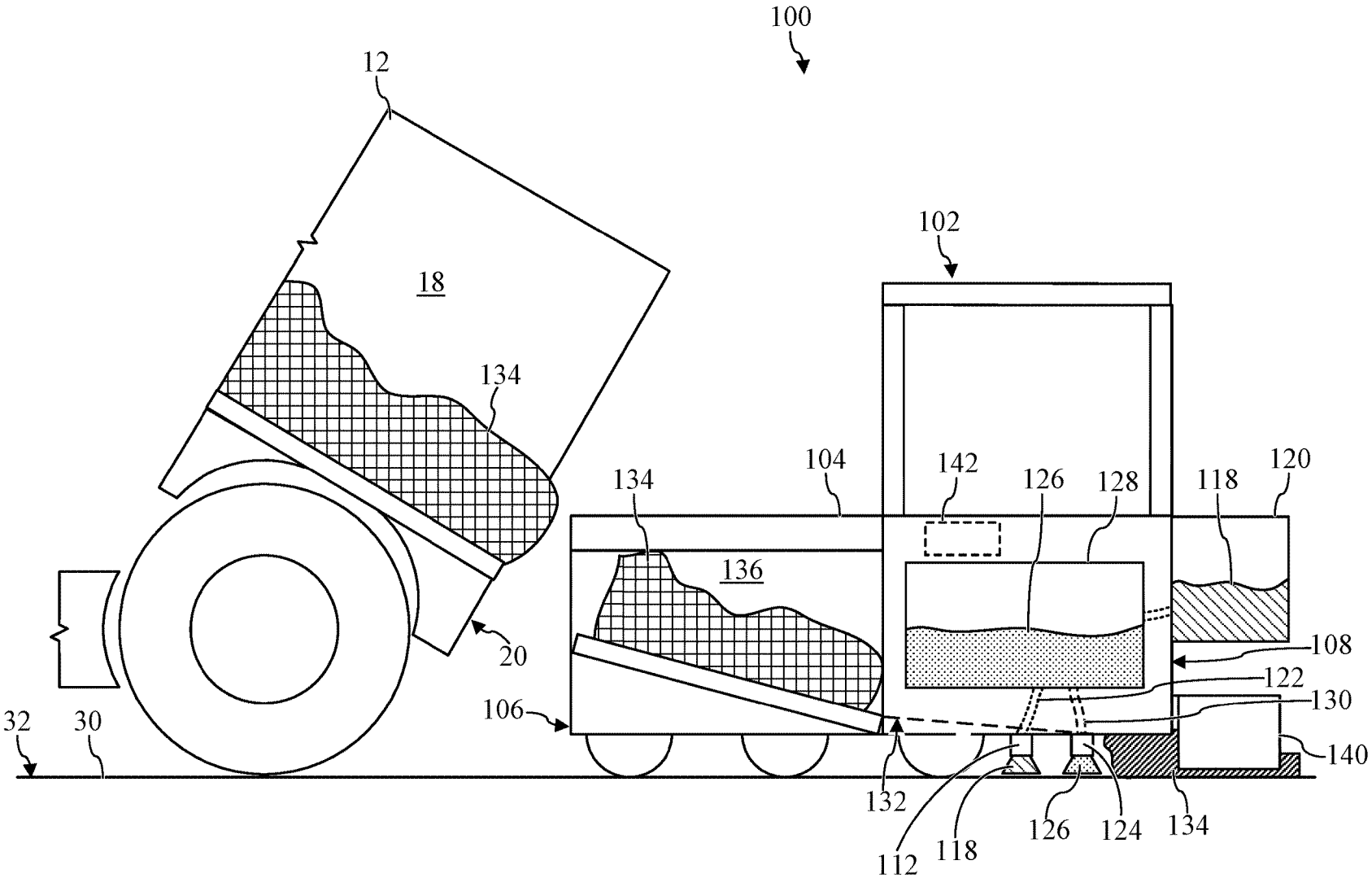

FIG. 5 show another non-limiting example where first group of sprayers 112 may be positioned on underside 110 of body 104 for paving machine 102, and may also be positioned adjacent to back end 108. That is, and as shown in FIG. 5, first group of sprayers 112 may be positioned substantially adjacent to or closer to back end 108 of paving machine 102 than front end 106, e.g., downstream of two or more axels, or past last wheel. In the non-limiting example, first group of sprayers 112 may also be positioned adjacent to second group of sprayers 124. More specifically, first group of sprayers 112 may be positioned directly adjacent to and upstream of second group of sprayers 112.

Figure 6:
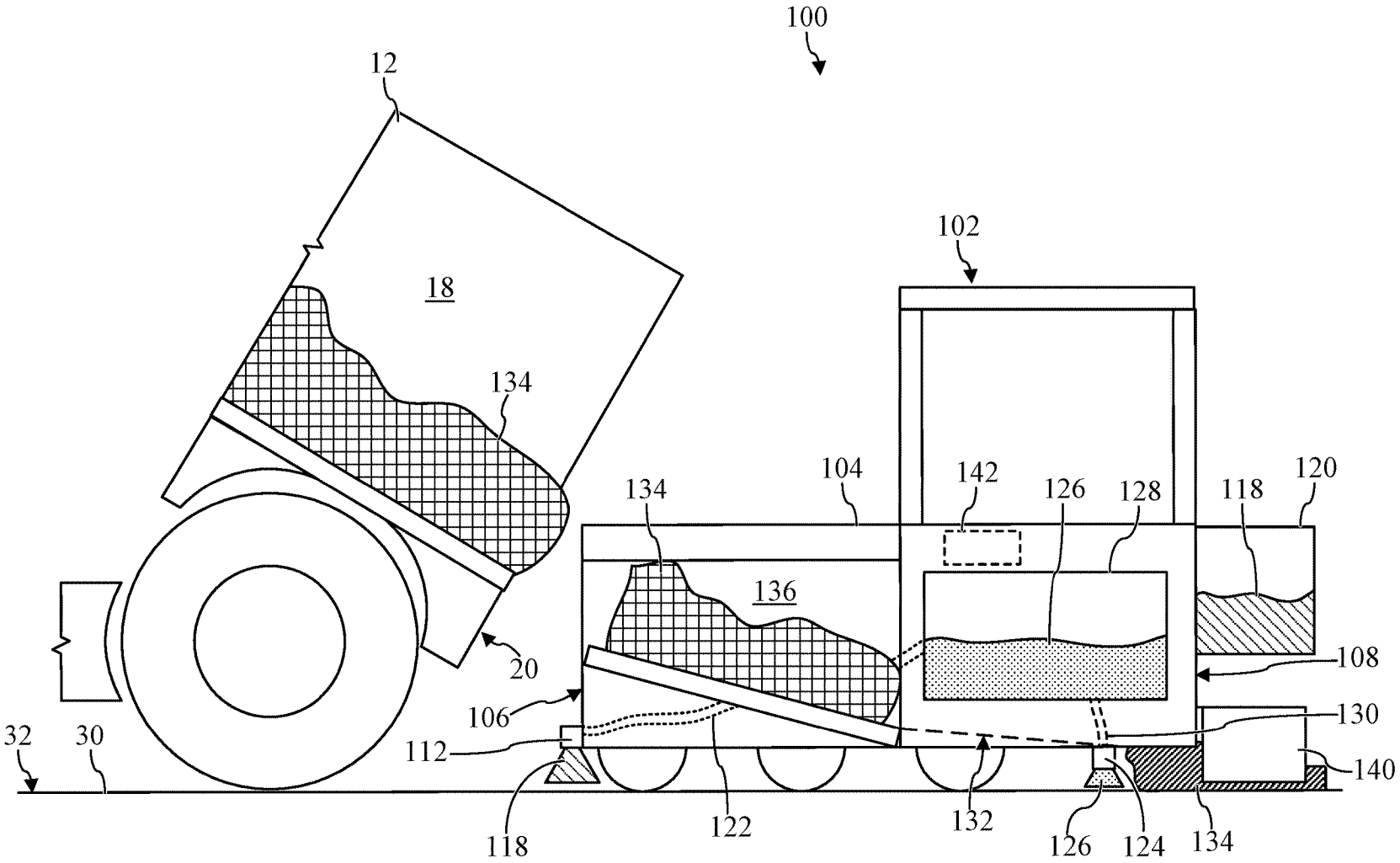
Figure 7:
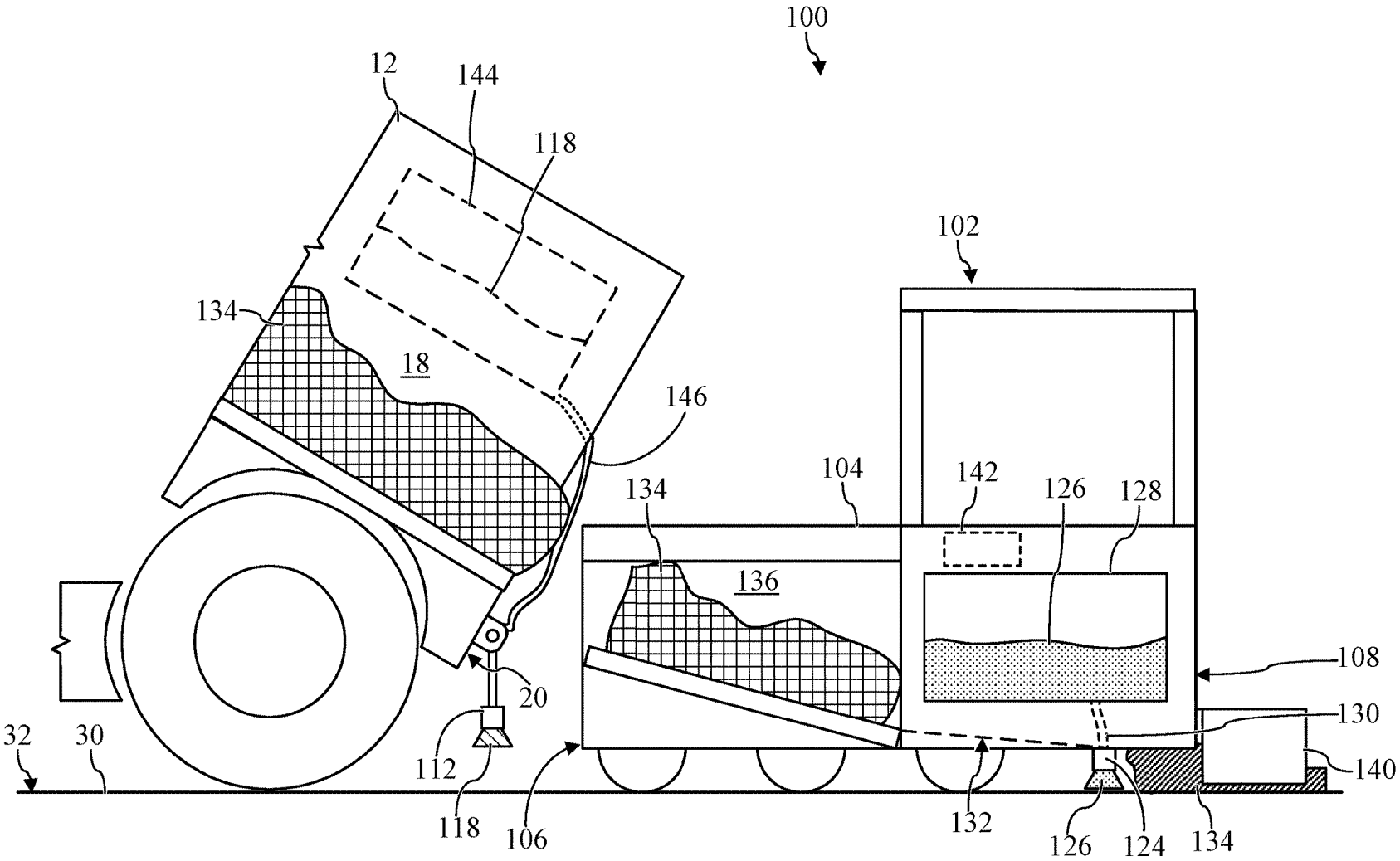

In a non-limiting example shown in FIG. 6, first group of sprayers 112 may be positioned directly on front end 106 of body 104 for paving machine 102, e.g., extending from, beyond, etc. In this non-limiting example, first group of sprayers 112 may not be positioned, coupled, and/or affixed to underside 110 of body 104 for paving machine 102.

In other non-limiting examples, paving machine 102 may not include first group of sprayers 112 thereon. Rather, first group of sprayers 112 may be formed and/or positioned on distinct portions of system 100 including paving machine 102. For example, and turning to FIG. 7, first group of sprayers 112 may be included on dump truck 12. First group of sprayers 112 may be formed, positioned on, and/or coupled to rear end 20 of dump truck 12. As such, as dump truck 12 drives along existing road 30, first group of sprayers 112 included in/on dump truck 12 may dispense first product 118 over existing road 30, as similarly discussed herein. In the non-limiting example first group of sprayers 112 are positioned on dump truck 12, dump truck 12 of system 100 may also include a reservoir 144 and a conduit 146 fluidly coupling reservoir 144 and first group of sprayers 112 and reservoir. Reservoir 144 positioned or coupled to dump truck 12 may include, contain, store, and/or hold first product 118. Additionally, conduit 146 may provide first product 118 contained in reservoir 144 to first group of sprayers 112 during the repaving process discussed herein. Similar to paving machine 102 discussed herein with respect to FIGS. 1 and 2, first group of sprayers 112, reservoir 144, and/or conduit 146 may be formed from or include any additional, suitable dispensing component that may allow for metered or controlled dispensing (e.g., controlled flow rate).

Figure 8:
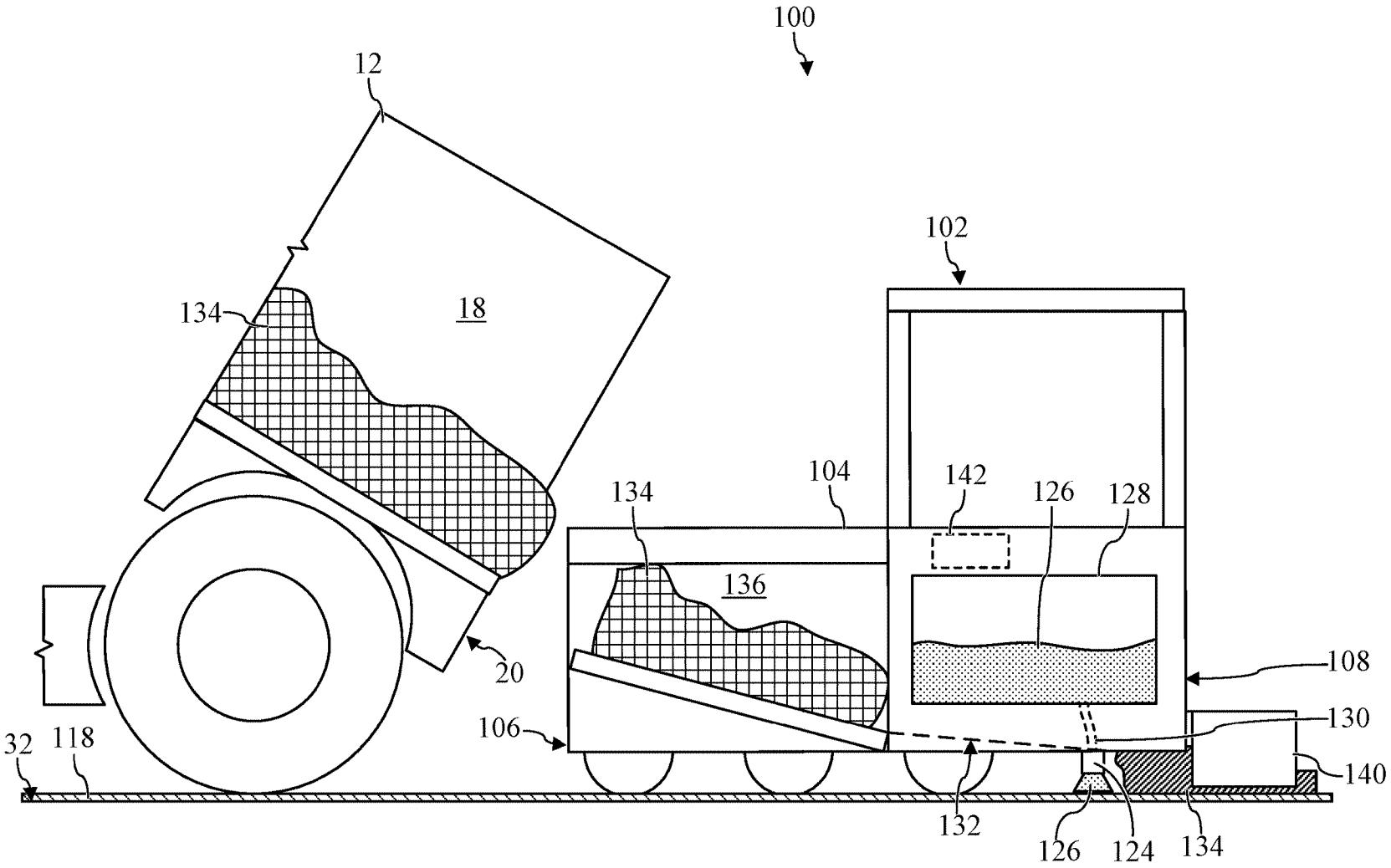

In the non-limiting example shown in FIG. 8, first product 118 may be dispensed, provided, and/or flowed over existing road 30 prior to system 100 resurfacing road 30. That is, prior to driving dump truck 12 and paving machine 102 (not including first group of sprayers 112) over existing road 30, a distinct machine or vehicle (e.g., spray truck) including first group of sprayers 112 and first product 118 may drive over existing road 30 and dispense first product 118 thereover. Once complete, system 100 including dump truck 12 and paving machine 102 may subsequently drive over road 30 including first product 118 and perform the resurfacing process discussed herein (e.g., depositing second product 126 and asphalt mixture 134).

Figure 9:
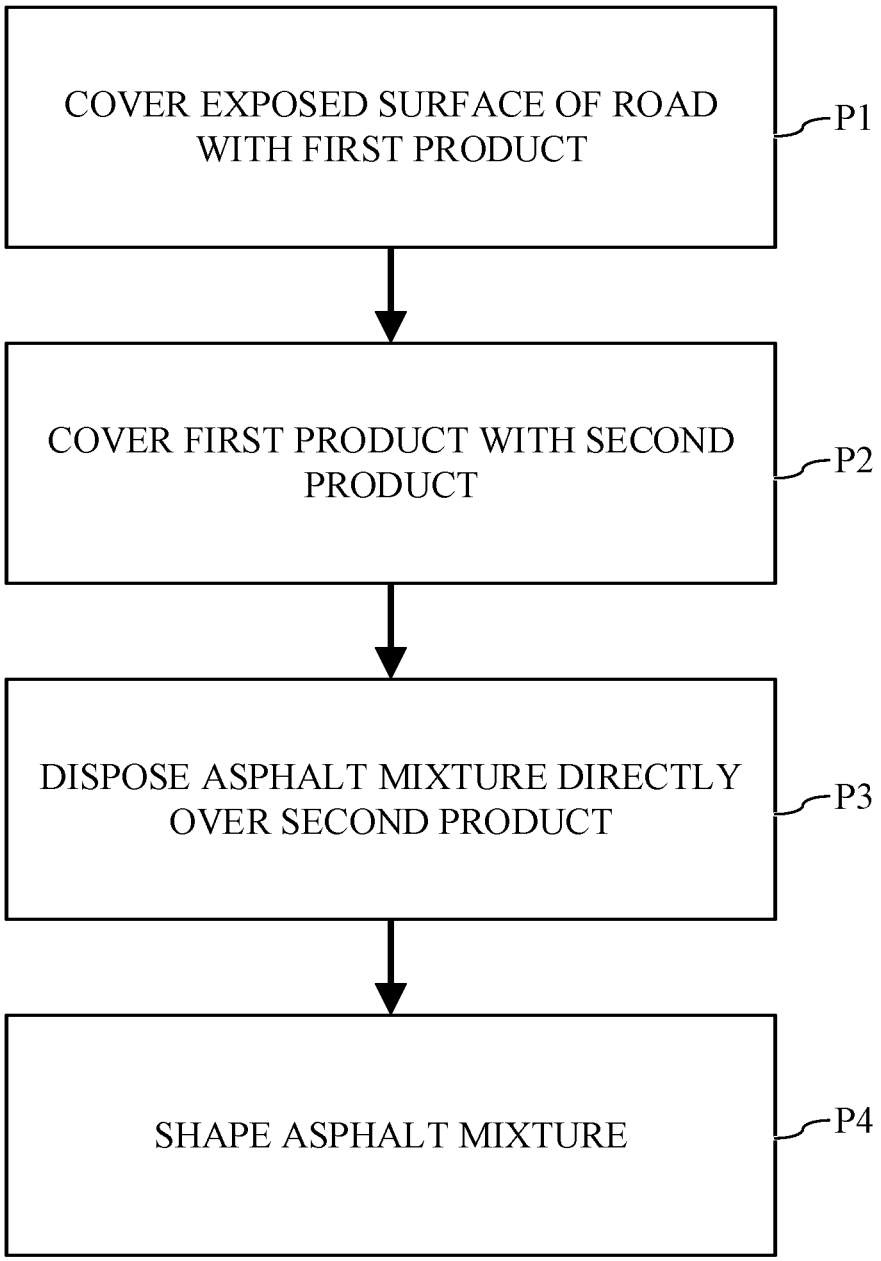
FIG. 9 shows a flow chart illustrating various processes for resurfacing an existing road, according to embodiments of the disclosure.

FIG. 9 depicts an example process for resurfacing an exposed surface. Specifically, FIG. 9 is a flowchart depicting one example process for resurfacing an exposed surface of an existing road including surface defects. In some cases, a road resurfacing system may be used to form the resurfaced road, as discussed above with respect to FIGS. 1, 2, and 4-8.

In process P1, the exposed surface of an existing road including surface defects may be covered with a layer of first product. A layer of first product may be disposed over the existing road to cover the exposed surface of the existing road. Covering the exposed surface with the layer of the first product may also include bonding the layer of the first product to the exposed surface of the existing road. Covering the exposed surface with the layer of the first product may further include sealing the exposed surface of the existing road including surface defects. The sealing of the exposed surface of the existing road may further include filling surface defects formed in the exposed surface of the existing road with a portion of the first product forming the first layer of the first product. Covering the exposed surface may further include penetrating the existing road with the first product. By penetrating the exposed surface of the existing road with the first product, the material composition of the existing road may be altered and/or a portion of the existing road may be mended. That is, covering the exposed surface of the existing road and/or penetrating the exposed surface with the first product may further include altering the material composition of at least a portion of the existing road, and/or mending preexisting cracks/defects formed in at least the portion of the existing road.

In process P2, the first product may be covered with a layer of a second product. More specifically, the first product covering and/or penetrating the existing road may be covered by a layer of a second product. Covering the first product may include spraying a second product such as, e.g., a binding material. For instance, the second product may include an asphalt emulsion, asphalt cement, polymer material, polymer modified asphalt cement, and the like. In various implementations, the second product is applied over the first product prior to the first product setting, e.g., within minutes (e.g., within 1-3 minutes, 3-5 minutes, or up to 5-10 minutes). In particular cases, the second product is applied over the first product within several minutes, e.g., while the first product is still hot.

In process P3, an asphalt mixture may be disposed directly over the layer of the second product. An asphalt mixture formed from a combination of asphalt emulsion (or asphalt cement) and aggregate may be disposed, deposited and/or cover the layer of the second product covering the layer of the first product, respectively. Disposing the asphalt mixture directly over the layer of the second product may also include bonding the asphalt mixture to the layer(s) of the second product and/or first product. Disposing the asphalt mixture directly over the layer of the second product may further include embedding the asphalt mixture into the layer(s) of the second product and/or first product. In various implementations, the third product is applied over the first product and the second product prior to the first product and the second product setting, e.g., within minutes (e.g., within 1-3 minutes, 3-5 minutes, or up to 5-10 minutes). In particular cases, the third product is applied over the first product and the second product within several minutes. In more particular cases, the third product is applied within approximately 5-10 minutes of application of the first product, and within several minutes of application of the second product.

In process P4, the asphalt mixture disposed over the layer of the second product may be shaped. The asphalt mixture disposed directly over, bonded, and embedded into the layer of the second product may be shaped to a desire finish to form a top, drivable layer of a resurfaced road. The shaping of the asphalt mixture disposed over the layer of the second product may include pressing and/or applying a pressure or force to the asphalt mixture. The asphalt mixture may be pressed directly into the layer of the second product.

FIGS. 10-13 show side views of existing road 30 undergoing a process (e.g., process P1-P4) discussed herein with respect to FIG. 9. Specifically, FIGS. 10-13 show existing road 30 going through the process of resurfacing the existing road 30 including surface defects 34 formed in exposed surface 32. Each process shown in FIGS. 10-13 may, for example, be performed using the road resurfacing system 100 and/or paving machine 102, discussed herein with respect to FIGS. 1, 2 and 4-8.

Figure 10:
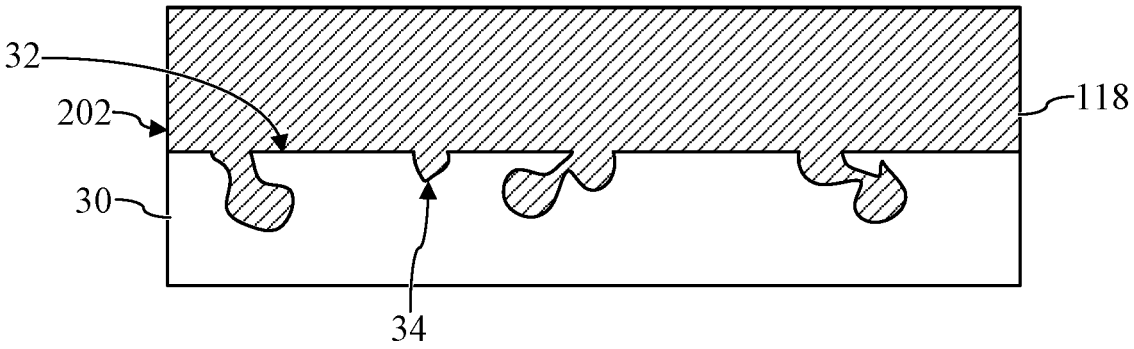
FIGS. 10-13 show side cross-section views of an existing road undergoing resurfacing processes similar to those shown in FIG. 9, according to embodiments of the disclosure.

FIG. 10 shows existing road 30 including first product 118 disposed thereover. That is, FIG. 10 may show existing road 30 immediately after first product 118 is disposed directly over and/or substantially covers exposed surface 32 of existing road 30. Additionally, the non-limiting example shown in FIG. 10 may depict existing road 30 prior to first product 118 penetrating at least a portion of existing road 30.

Figure 11:
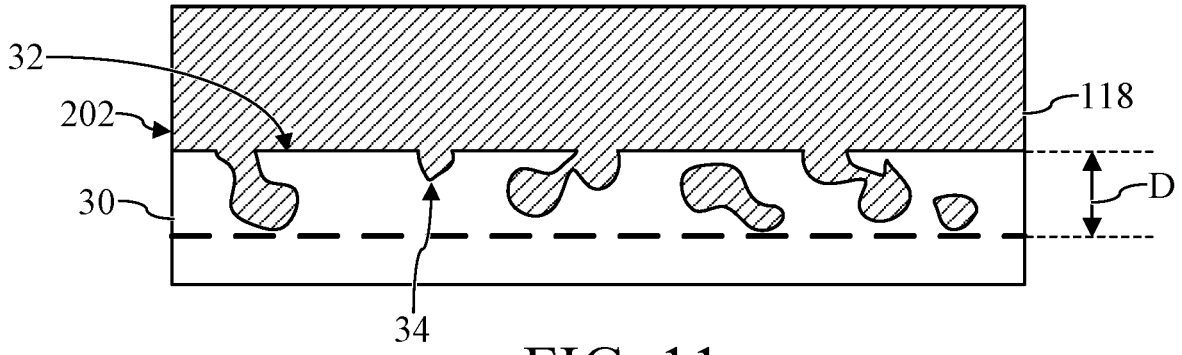

FIG. 11 shows existing road 30 after first product 118 covers exposed surface 32 and penetrates a portion of existing road 30. More specifically, first product 118 may penetrate into existing road 30 at a distance (D). By penetrating existing road 30, first product 118 may also alter the material composition of at least a portion of existing road 30, and/or mend preexisting cracks/defects (e.g., surface defects 34) formed in at least the portion of existing road 30. The non-limiting examples of existing road 30 shown in FIGS. 10 and 11 may correspond to process P1 discussed herein with respect to FIG. 9.

Figure 12:
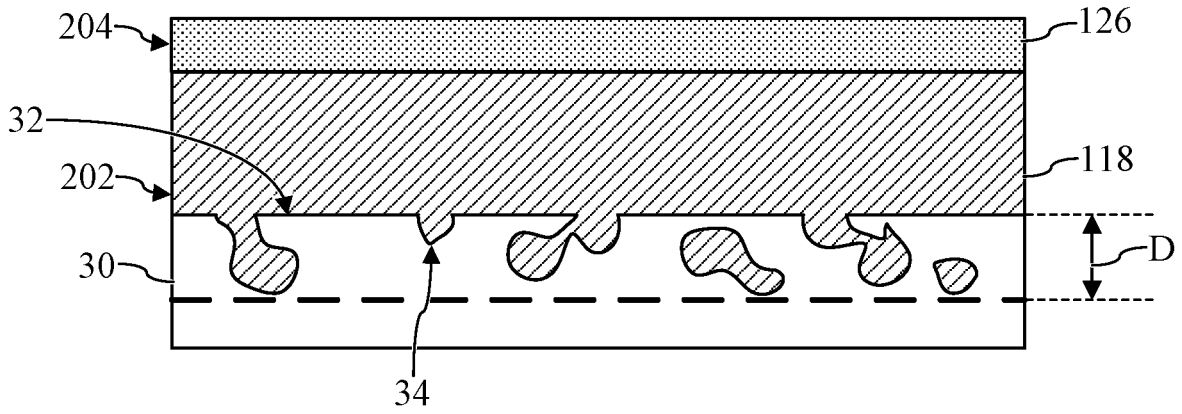

FIG. 12 shows a second product 126 covering first product 118. Second product 126 may be disposed over, substantially cover, and/or at least partially being embedded within first product 118 previously or first disposed over existing road 30. Covering first product 118 with second product 126, as shown in FIG. 12, may correspond to process P2 discussed herein with respect to FIG. 9.

Figure 13:
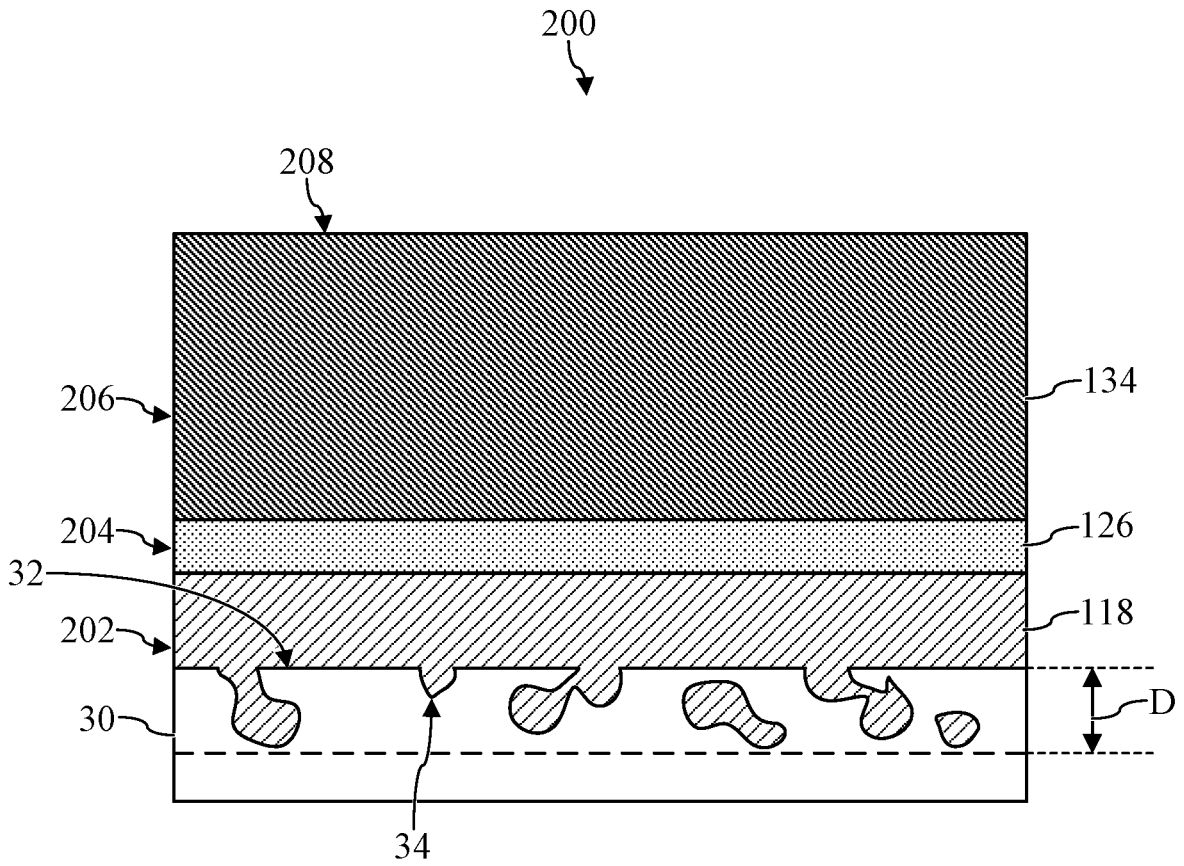

FIG. 13 shows the asphalt mixture 134 disposed over second product 126. Asphalt mixture 134 may be disposed over, substantially cover, and/or at least partially being embedded within second product 126. Additionally, and/or alternatively, at least a portion of second product 126 may seep, penetrate, and/or be absorbed into asphalt mixture 134. Asphalt mixture 134 shown in FIG. 13 may also be substantially shaped. That is, subsequent to disposing asphalt mixture 134 over second product 126, the asphalt mixture 134 may be shaped to form a final, resurface road 200. The disposing of the asphalt mixture 134 and subsequent shaping shown in FIG. 13 may correspond to processes P3 and P4 discussed herein with respect to FIG. 9.

As noted herein, the disclosed approaches can provide for enhanced bonding between an asphalt topcoat and an underlying, existing roadway. Application of asphalt over a rejuvenator prior to setting of the rejuvenator enables the softened existing roadway to effectively bond with the asphalt topcoat. Additionally, integrating rejuvenation application and asphalt application in a single machine and/or single, fluid process enables faster setting of the roadway, with less downtime.

The flowchart and block diagrams in the Figures illustrate the architecture, functionality, and operation of possible implementations of systems, methods and computer program products according to various embodiments of the present disclosure. In this regard, each block in the flowchart or block diagrams may represent a module, segment, or portion of code, which comprises one or more executable instructions for implementing the specified logical function(s). It should also be noted that, in some alternative implementations, the functions noted in the block may occur out of the order noted in the figures. For example, two blocks shown in succession may, in fact, be executed substantially concurrently, or the blocks may sometimes be executed in the reverse order, depending upon the functionality involved. It will also be noted that each block of the block diagrams and/or flowchart illustration, and combinations of blocks in the block diagrams and/or flowchart illustration, can be implemented by special purpose hardware-based systems that perform the specified functions or acts, or combinations of special purpose hardware and computer instructions.

The foregoing drawings show some of the processing associated according to several embodiments of this disclosure. In this regard, each drawing or block within a flow diagram of the drawings represents a process associated with embodiments of the method described. It should also be noted that in some alternative implementations, the acts noted in the drawings or blocks may occur out of the order noted in the figure or, for example, may in fact be executed substantially concurrently or in the reverse order, depending upon the act involved. Also, one of ordinary skill in the art will recognize that additional blocks that describe the processing may be added.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising." when used in this specification, specify the presence of stated features, integers, steps, operations, elements, and/or components, but do not preclude the presence or addition of one or more other features, integers, steps, operations, elements, components, and/or groups thereof. "Optional" or "optionally" means that the subsequently described event or circumstance may or may not occur, and that the description includes instances where the event occurs and instances where it does not.

Approximating language, as used herein throughout the specification and claims, may be applied to modify any quantitative representation that could permissibly vary without resulting in a change in the basic function to which it is related. Accordingly, a value modified by a term or terms, such as "about," "approximately" and "substantially," are not to be limited to the precise value specified. In at least some instances, the approximating language may correspond to the precision of an instrument for measuring the value. Here and throughout the specification and claims, range limitations may be combined and/or interchanged, such ranges are identified and include all the sub-ranges contained therein unless context or language indicates otherwise. "Approximately" as applied to a particular value of a range applies to both values, and unless otherwise dependent on the precision of the instrument measuring the value, may indicate +/−10% of the stated value(s).

The corresponding structures, materials, acts, and equivalents of all means or step plus function elements in the claims below are intended to include any structure, material, or act for performing the function in combination with other claimed elements as specifically claimed. The description of the present disclosure has been presented for purposes of illustration and description, but is not intended to be exhaustive or limited to the disclosure in the form disclosed. Many modifications and variations will be apparent to those of ordinary skill in the art without departing from the scope and spirit of the disclosure. The embodiment was chosen and described in order to best explain the principles of the disclosure and the practical application, and to enable others of ordinary skill in the art to understand the disclosure for various embodiments with various modifications as are suited to the particular use contemplated.

The functionality described herein, or portions thereof, and its various modifications (hereinafter "the functions") can be implemented, at least in part, via a computer program product, e.g., a computer program tangibly embodied in an information carrier, such as one or more non-transitory machine-readable media, for execution by, or to control the operation of, one or more data processing apparatus, e.g., a programmable processor, a computer, multiple computers, and/or programmable logic components.

A computer program can be written in any form of programming language, including compiled or interpreted languages, and it can be deployed in any form, including as a stand-alone program or as a module, component, subroutine, or other unit suitable for use in a computing environment. A computer program can be deployed to be executed on one computer or on multiple computers at one site or distributed across multiple sites and interconnected by a network.

Actions associated with implementing all or part of the functions can be performed by one or more programmable processors executing one or more computer programs to perform the functions of the calibration process. All or part of the functions can be implemented as, special purpose logic circuitry, e.g., an FPGA and/or an ASIC (application-specific integrated circuit). Processors suitable for the execution of a computer program include, by way of example, both general and special purpose microprocessors, and any one or more processors of any kind of digital computer. Generally, a processor will receive instructions and data from a read-only memory or a random access memory or both. Components of a computer include a processor for executing instructions and one or more memory devices for storing instructions and data.

In various implementations, components described as being "coupled" or "connected" to one another can be joined along one or more interfaces. In some implementations, these interfaces can include junctions between distinct components, and in other cases, these interfaces can include a solidly and/or integrally formed interconnection. That is, in some cases, components that are "coupled" or "connected" to one another can be simultaneously formed to define a single continuous member. However, in other implementations, these coupled components can be formed as separate members and be subsequently joined through known processes (e.g., soldering, fastening, ultrasonic welding, bonding). In various implementations, electronic components described as being "coupled" or "connected" can be linked via conventional hard-wired and/or wireless means such that these electronic components can communicate data with one another. Additionally, sub-components within a given component can be considered to be linked via conventional pathways, which may not necessarily be illustrated.

A number of implementations have been described. Nevertheless, it will be understood that additional modifications may be made without departing from the scope of the inventive concepts described herein, and, accordingly, other embodiments are within the scope of the following claims.

What is claimed is:

1. A paving machine, comprising:

a body including a front end, a back end positioned opposite the front end, and an underside extending between the front end and the back end;

a first group of sprayers positioned on or extending forward of the underside of the front end of the body, the first group of sprayers for dispensing a first product on an existing road;

a second group of sprayers positioned downstream of the first group of sprayers, the second group of sprayers for dispensing a second product over the first product dispensed by the first group of sprayers;

a channel positioned adjacent to and downstream of the second group of sprayers, the channel providing an asphalt mixture over the second product; and a screed positioned adjacent the channel, the screed contacting the asphalt mixture provided by the channel.

2. The paving machine of claim 1, wherein the first group of sprayers is positioned downstream from the front end of the body.

3. The paving machine of claim 1, wherein the first product dispensed by the first group of sprayers includes a modifier, a liquid road rejuvenator product, or a mixture thereof.

4. The paving machine of claim 1, wherein the second product dispensed by the second group of sprayers includes an asphalt emulsion.

5. The paving machine of claim 1, wherein the asphalt mixture provided by the channel includes a hot mixture, a warm mixture, or a cold mixture.

6. The paving machine of claim 1, further comprising:

a hopper in communication with the channel, the hopper for receiving the asphalt mixture and providing the asphalt mixture to the channel.

7. The paving machine of claim 1, wherein the channel is positioned between the second group of sprayers and the screed.

8. A system comprising:

a first group of sprayers positioned on or extending forward of an underside of a front end of a paving machine, the first group of sprayers for dispensing a first product on an existing road; and the paving machine including:

a second group of sprayers positioned downstream of the front end of the body, the second group of sprayers for dispensing a second product over the first product dispensed by the first group of sprayers;

a channel positioned adjacent to and downstream of the second group of sprayers, the channel for providing an asphalt mixture over the second product; and a screed positioned adjacent the channel, the screed contacting the asphalt mixture provided by the channel.

9. The system of claim 8, wherein the paving machine includes a spray machine including:

a storage tank containing the first product, the storage tank in communication with the first group of sprayers to provide the first product to the first group of sprayers.

10. The system of claim 9, further comprising:

a dump truck including a dump box, the dump box for storing the asphalt mixture and providing the asphalt mixture to the paving machine.

11. The system of claim 8, wherein the first product dispensed by the first group of sprayers includes a modifier, a liquid road rejuvenator product, or a combination thereof.

12. The system of claim 8, wherein the second product dispensed by the second group of sprayers includes an asphalt emulsion.

13. The system of claim 8, wherein the asphalt mixture provided by the channel includes a hot mixture, a warm mixture, or a cold mixture.

14. The system of claim 8, wherein the paving machine further includes:

a hopper in communication with the channel, the hopper for receiving the asphalt mixture and providing the asphalt mixture to the channel.

15. The system of claim 8, wherein the channel of the paving machine is positioned between the second group of sprayers and the screed.

16. A method for resurfacing an existing road using a paving machine, the method comprising:

covering an exposed surface of the existing road with a first product;

covering the first product disposed over the exposed surface of the existing road with a second product, wherein the first product dispensed by a first group of sprayers disposed on or extending forward of the underside of a front end of a body of the paving machine includes a modifier, a liquid road rejuvenator product, or a combination thereof, and wherein the second product dispensed by a second group of sprayers includes an asphalt emulsion;

disposing an asphalt mixture directly over the second product; and shaping the asphalt mixture disposed over the second product.

* * * * *